US008337325B2

(12) United States Patent
Boyd et al.

(10) Patent No.: US 8,337,325 B2
(45) Date of Patent: Dec. 25, 2012

(54) IRON TYPE GOLF CLUBS AND GOLF CLUB HEADS HAVING WEIGHT CONTAINING AND/OR VIBRATION DAMPING INSERT MEMBERS

(75) Inventors: Robert Boyd, Euless, TX (US); Byron C Slaughter, Granbury, TX (US); Charles Jack Green, III, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 172 days.

(21) Appl. No.: 11/846,362

(22) Filed: Aug. 28, 2007

(65) Prior Publication Data

US 2009/0062032 A1 Mar. 5, 2009

(51) Int. Cl.
*A63B 53/04* (2006.01)
*A63B 53/06* (2006.01)

(52) U.S. Cl. ..... 473/332; 473/334; 473/350

(58) Field of Classification Search ..... 473/324–350
See application file for complete search history.

(56) References Cited

U.S. PATENT DOCUMENTS

| | | | | |
|---|---|---|---|---|
| 4,043,563 | A * | 8/1977 | Churchward | 473/338 |
| 4,340,230 | A * | 7/1982 | Churchward | 473/339 |
| 5,050,879 | A * | 9/1991 | Sun et al. | 473/338 |
| 6,077,171 | A * | 6/2000 | Yoneyama | 473/291 |
| 6,290,607 | B1 * | 9/2001 | Gilbert et al. | 473/291 |
| 6,482,104 | B1 * | 11/2002 | Gilbert | 473/287 |
| 6,592,469 | B2 * | 7/2003 | Gilbert | 473/350 |
| 6,616,547 | B2 * | 9/2003 | Vincent et al. | 473/334 |
| 6,811,496 | B2 * | 11/2004 | Wahl et al. | 473/334 |
| 6,902,495 | B2 * | 6/2005 | Pergande et al. | 473/332 |
| 6,921,344 | B2 * | 7/2005 | Gilbert et al. | 473/334 |
| 7,186,188 | B2 * | 3/2007 | Gilbert et al. | 473/290 |
| 7,192,361 | B2 * | 3/2007 | Gilbert et al. | 473/290 |
| 7,232,377 | B2 * | 6/2007 | Gilbert et al. | 473/290 |
| 7,371,190 | B2 * | 5/2008 | Gilbert et al. | 473/332 |
| 7,485,049 | B2 * | 2/2009 | Gilbert et al. | 473/290 |
| 7,559,850 | B2 * | 7/2009 | Gilbert et al. | 473/290 |
| 7,654,914 | B2 * | 2/2010 | Roach et al. | 473/350 |

(Continued)

FOREIGN PATENT DOCUMENTS

| | | |
|---|---|---|
| JP | 3038925 | 6/1997 |
| JP | 2002224255 | 8/2002 |
| JP | 2005058765 | 3/2005 |

(Continued)

OTHER PUBLICATIONS

International Search Report in corresponding PCT Application, International Application No. PCT/US2008/073977, mailed Nov. 7, 2008.

(Continued)

*Primary Examiner* — Alvin Hunter
(74) *Attorney, Agent, or Firm* — Banner & Witcoff, Ltd.

(57) ABSTRACT

Iron golf clubs heads and clubs include: (a) a ball striking face; (b) an opposite rear surface; (c) a sole portion extending rearward from the ball striking face and defining a cavity having an open upper portion; (d) an insert element mounted in the cavity, wherein the insert element includes at least one weight port; and (e) a weight member mounted in the port. The insert element may substantially fill the cavity to dampen vibrations and/or noise when a ball is struck. Additionally, the insert element may allow the weight(s) to be selectively placed to enable customization and tuning of the overall weight of the club head (e.g., for swing weighting purposes, for ball flight control purposes, etc.). Methods of making such club heads and clubs also are described.

26 Claims, 3 Drawing Sheets

U.S. PATENT DOCUMENTS

| | | | | |
|---|---|---|---|---|
| 7,980,960 | B2 * | 7/2011 | Gilbert et al. | 473/290 |
| 2003/0203764 | A1 | 10/2003 | Dabbs et al. | |
| 2004/0092331 | A1 | 5/2004 | Best | |
| 2005/0026716 | A1 * | 2/2005 | Wahl et al. | 473/334 |
| 2005/0266932 | A1 * | 12/2005 | Roach et al. | 473/332 |
| 2006/0234805 | A1 | 10/2006 | Gilbert | |
| 2006/0234811 | A1 | 10/2006 | Gilbert et al. | |
| 2006/0240908 | A1 | 10/2006 | Adams et al. | |

FOREIGN PATENT DOCUMENTS

| | | |
|---|---|---|
| JP | 2005130911 | 5/2005 |
| JP | 2006-051366 | 2/2006 |
| JP | 3129489 | 2/2007 |
| WO | 2004/022172 | 3/2004 |

OTHER PUBLICATIONS

Office Action issued on Apr. 14, 2010 in corresponding Chinese Application No. 200810146727.5.

Certificate of Utility Model Patent issued on Oct. 28, 2009 in corresponding Chinese Application No. 200820132778.8.

International Preliminary Report on Patentability and Written Opinion in corresponding PCT/US2008/073977 dated Mar. 11, 2010.

Office Action issued on Nov. 19, 2010 in corresponding Australian Application No. 2008296623.

Aug. 4, 2011 Office Action issued in corresponding Canadian Application No. 2,697,502.

Nov. 18, 2011 Office Action issued in corresponding Korean Application No. 10-2010-7004546.

May 2, 2012 Office Action issued in Japanese Application No. 2010-523055 (english translation).

Oct. 24, 2012, Office Action issued in Korean Application No. 10-2010-7004546.

Oct. 24, 2012, EP Communication for EP Application No. 08798456.3.

* cited by examiner

IRON TYPE GOLF CLUBS AND GOLF CLUB HEADS HAVING WEIGHT CONTAINING AND/OR VIBRATION DAMPING INSERT MEMBERS

FIELD OF THE INVENTION

The present invention relates to iron type golf clubs and golf club heads. Particular example aspects of this invention relate to golf clubs and golf club heads having an insert member within a cavity for vibration/noise damping and/or for selective weighting purposes.

BACKGROUND

Various golf club heads have been designed to improve a golfer's accuracy by assisting the golfer in squaring the club head face at impact with a golf ball. A number of golf club heads reposition the weight of the golf club head in order to alter the location of the club head's center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices". Similarly, when the center of gravity is spaced above or below the point of engagement, the flight of the golf ball may exhibit more boring or climbing trajectories, respectively.

Golf club heads, such as perimeter weighted and cavity back club heads, assist the golfer by locating much of the weight of the golf club head around the golf club head perimeter. Generally, these golf club heads are more forgiving than non-cavity back golf club heads (e.g., traditional "blade" type irons) thereby allowing a golf ball to be struck somewhat off center or mis-hit, while still providing relatively good distance and accuracy. Perimeter weighted and cavity back club heads have helped the average golfer reduce the impact of mis-hits and improve scoring.

Golfers tend to be sensitive to the "feel" of a golf club. The "feel" of a golf club comprises the combination of various component parts of the club and various features associated with the club that produce the sensory sensations experienced by the player when a ball is swung at and/or struck. Club weight, weight distribution, swing weight, aerodynamics, swing speed, and the like all may affect the "feel" of a golf club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

Accordingly, improving aspects of a golf club's "feel" and providing an easy and efficient way to produce a consistent "feel" throughout a set of golf clubs (e.g., a set of irons) would be welcome feature in the art.

SUMMARY OF THE INVENTION

Iron type golf club heads according to at least some example aspects of this invention include: (a) a ball striking face; (b) a rear surface opposite the ball striking face; (c) a sole portion extending rearward from the ball striking face, the sole portion and the rear surface defining a cavity that has an open upper portion; (d) an insert element mounted in the cavity, wherein the insert element includes an upper surface exposed at the open upper portion of the cavity and an opposite lower surface, and wherein the lower surface includes at least a first weight port therein; and (e) a first weight member mounted in the first weight port. The insert element may include multiple weight ports (e.g., one or more in the toe end, one or more in the heel end, one or more in the central region, etc.), and one or more weights may be mounted in any desired number of these weight ports. The insert element may be made from suitable materials and/or positioned within the club head cavity so as to dampen vibrations and/or affect the sound produced when a ball (or other object) is struck and/or so as to enable customization and/or tuning of the overall weight of the club head (e.g., for swing weighting purposes, for ball flight control purposes (e.g., to draw bias the club, to fade bias the club, to help compensate for swing flaws that produce a hook, to help compensate for swing flaws that produce a slice, etc.), etc.).

Additional aspects of this invention relate to iron type golf clubs and to methods for producing iron golf club heads and golf clubs including club heads with insert members of the types described above.

BRIEF DESCRIPTION OF THE DRAWINGS

The present invention is illustrated by way of example and not limited in the accompanying figures, in which like reference numerals indicate similar elements throughout, and in which.

DETAILED DESCRIPTION

Figure 1:
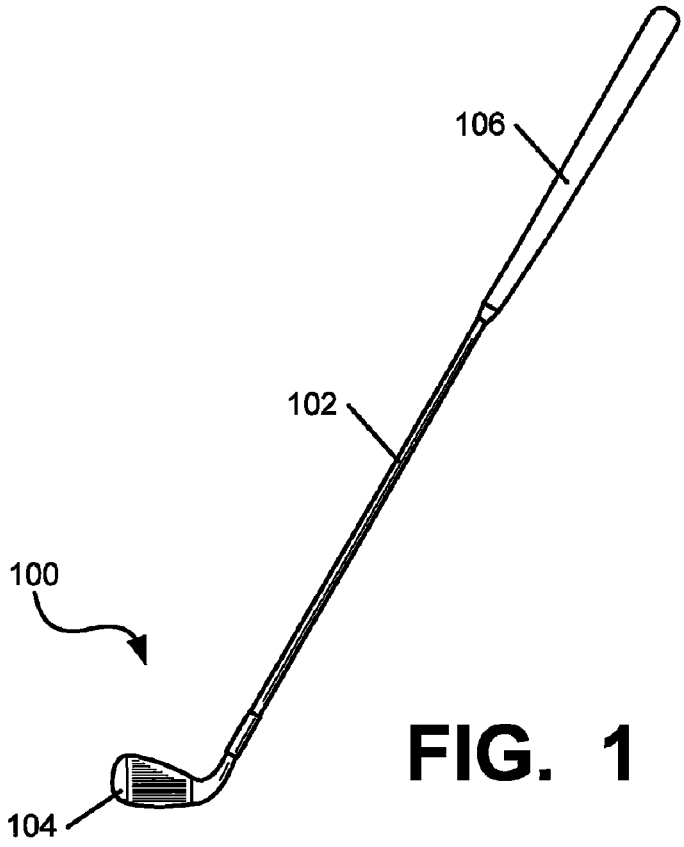
FIG. 1 illustrates a view of an example golf club having an example golf club head in accordance with the present invention.

The following description and the accompanying figures disclose features of golf club heads and golf clubs in accordance with the present invention (e.g., iron or iron-type hybrid golf clubs and golf club heads).

I. GENERAL DESCRIPTION OF EXAMPLE GOLF CLUB HEADS, GOLF CLUBS, AND METHODS IN ACCORDANCE WITH THIS INVENTION

Aspects of this invention generally relate to iron type golf club heads and golf clubs including such club heads (e.g., iron type hybrid clubs, driving irons, 0-9 irons, pitching wedges, sand wedges, gap wedges, loft wedges, etc.), although aspects of this invention may be extended for use in other club head structures, such as putters, drivers, woods, etc. Iron type golf club heads according to at least some example aspects of this invention may include: (a) a ball striking face; (b) a rear surface opposite the ball striking face (e.g., the actual back surface of the ball striking face or another structural member of the club head); (c) a sole portion extending rearward from the ball striking face, the sole portion and the rear surface defining a cavity that has an open upper portion; (d) an insert element mounted in the cavity, wherein the insert element includes an upper surface exposed at the open upper portion of the cavity and an opposite lower surface, and wherein the lower surface includes at least a first weight port therein; and (e) a first weight member engaged with the first weight port. The insert element may include multiple weight ports (e.g., one or more in the toe end, one or more in the heel end, one or more in the central region, etc.), and one or more weights may be mounted in any desired number of these weight ports. The golf club head may have a generally perimeter weighted and/or cavity back type structure as is known or used in the art (e.g., with a sole portion extending rearwardly to form a portion of the perimeter weighting member structure).

While the insert element may be made from a variety of materials in a variety of different constructions, in at least some example structures according to this invention, it will be made of suitable materials and/or positioned within the club head cavity at a suitable position so as to dampen vibrations and/or alter the sound produced when a ball (or other object) is struck and/or so as to enable customization and tuning of the overall weight of the club head (e.g., for swing weighting purposes, for ball flight control purposes (e.g., to draw bias the club, to fade bias the club, to help compensate for swing flaws that produce a hook, to help compensate for swing flaws that produce a slice, etc.), etc.). As some more specific examples, if desired, the cavity and the insert element may be formed so as to be elongated in the club head's heel-to-toe direction (e.g., such that the cavity and/or insert element has an overall length dimension in the heel-to-toe direction of the club head that is at least twice its overall width dimension in a face-to-rear direction, or even at least three times its overall width dimension). In this manner, the weight ports and the weight members may be selectively located at the toe end of the insert element, at its heel end, at a central area, etc., so as to properly swing weight the club and/or so as to bias the club as desired for specific ball flight characteristics.

As some additional example features, the insert element may be made from one or more separate members that are joined together, such as from an upper polymer (or other material) member that is exposed at the cavity opening and a lower polymer (or other material) member that is hidden within the cavity (and contains the weight member). The upper polymer (or other material) member may be relatively hard and/or thin (e.g., having a base that is less than a 2 millimeters thick, having a hardness of 85 Shore A or greater, etc.) while the lower polymer (or other material) member may be relatively soft and thicker (e.g., having a height of at least 5 millimeters, a hardness of 70 Shore A or less, etc.). In this manner, the lower member will be softer than a metal or metal alloy material from which the ball striking face is constructed, and it will dampen vibrations and/or affect the sound created when the club head strikes a ball or other object.

In at least some example golf club head structures according to this invention, the insert element will substantially fill the cavity defined by the sole portion and the rear surface of the ball striking face (although not necessarily the entire cavity defined by the perimeter weighting of the cavity back club). Therefore, at least a portion of a side surface of the lower (softer) member will lie immediately adjacent to and/or in contact with the rear surface of the ball striking face. This feature also assists in dampening vibrations when a ball is struck. At the very least, the top portion of the insert member may be sized so as to substantially fill the open upper portion of the cavity (or at least some portion of the insert will substantially fill the cavity).

If desired, the insert element may be removably mounted in the cavity defined by the sole portion and/or the weight member(s) may be removably mounted in the weight port(s) of the insert element. Alternatively, if desired, the insert element may be permanently fixed into the cavity and/or the weight members may be permanently fixed in the weight ports (e.g., using an adhesive or cement, using fusing techniques, etc.), although the insert element still may include multiple weight ports so as to allow the manufacturer, club fitter, or other user to selectively place one or more weights in the desired port(s) so as to produce the desired swing weight or other weighting characteristics for the club.

Additional aspects of this invention relate to iron type golf clubs (e.g., iron type hybrid clubs, driving irons, 0-9 irons, pitching wedges, sand wedges, gap wedges, loft wedges, etc.). Such clubs may include, for example: (a) iron golf club heads of the types described above; (b) a shaft member engaged with the golf club head (e.g., at a hosel or other head connection area); and/or (c) a grip member engaged with the shaft member. The club head, its insert element, and/or its weight member may have any one or more of the various characteristics or properties described above. The clubs may have additional features and characteristics as well, including features and/or characteristics of conventional club heads as are known and used in the art.

Still additional aspects of this invention relate to methods for producing iron golf club heads, e.g., of the types described above. Such methods may include: (a) providing a club head body (e.g., by manufacturing it, by constructing it, by obtaining it from a third party source, etc.) including a ball striking face, a rear surface opposite the ball striking face, and a sole portion extending rearward from the ball striking face, wherein the sole portion and the rear surface define a cavity that has an open upper portion; (b) providing an insert element that includes an upper surface and an opposite lower surface, wherein the lower surface includes at least a first weight port therein; (c) inserting a first weight member in the first weight port; and (d) inserting the insert element into the cavity such that the upper surface of the insert element is exposed at the open upper portion of the cavity (and such that the weight members and weight ports are located at the bottom of the cavity and embedded in the insert member). The club head, its insert element, and/or its weight member(s) may be formed to have any one or more of the various characteristics or properties described above.

Additionally, if desired, methods in accordance with at least some examples of this invention may include one or more of the following additional steps: (a) removing the insert element from the cavity; (b) removing the first weight member from the first weight port; (c) inserting a second weight member into the first weight port; (d) inserting the first weight member into a second weight port defined in the lower surface of the insert element; (e) inserting a second weight member into a second weight port defined in the lower surface of the insert element; (f) reinserting the insert element into the cavity; and/or (g) inserting a new insert element into the cavity.

Methods of producing iron type golf clubs in accordance with at least some example aspects of this invention may include: providing a golf club head of the types described above (e.g., including any or all of the various structures, features, and/or arrangements described above, such as an insert element, one or more weight members, etc.), e.g., by manufacturing or otherwise making the golf club head, by obtaining it from a third party source, etc.; (b) engaging a shaft member with the golf club head; and/or (c) engaging a grip member with the shaft member. The club head may allow manufacturers, club fitters, users, or others to customize the weighting, weight locations, and/or other features of the club head, e.g., as described above and as will be described in more detail below.

Given the general description of aspects of the invention provided above, more detailed descriptions of various specific examples of golf clubs and golf club head structures according to the invention are provided below.

II. DETAILED DESCRIPTION OF EXAMPLE GOLF CLUB HEADS, GOLF CLUB STRUCTURES, AND METHODS ACCORDING TO THE INVENTION

The following discussion and accompanying figures describe various golf clubs and golf club head structures in accordance with examples of the present invention.

Referring to FIG. 1, an iron type golf club 100 in accordance with this invention includes a shaft 102 and a golf club head 104 attached to the shaft 102. The golf club head 104 of FIG. 1 may be representative of any iron or hybrid type golf club head, such as iron type hybrid clubs, driving irons, 0-9 irons, pitching wedges, sand wedges, gap wedges, loft wedges, etc. The shaft 102 of golf club 100 may be made of various materials, such as steel, aluminum, titanium, graphite, or composite materials, as well as alloys and/or combinations thereof, including materials that are conventionally known and used in the art. Additionally, the shaft 102 may be attached to the club head 104 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, via releasable mechanical connections, etc.). A grip or other handle element 106 is positioned on the shaft 102 to provide a golfer with a slip resistant surface with which to grasp golf club shaft 102. The grip element 106 may be attached to the shaft 102 in any desired manner, including in conventional manners known and used in the art (e.g., via adhesives or cements, via threads or other mechanical connectors, via fusing techniques, via friction fits, via retaining element structures, etc.). The grip element 106 may be made from any desired materials, including materials that are conventionally known and used in the art.

Figure 2A:
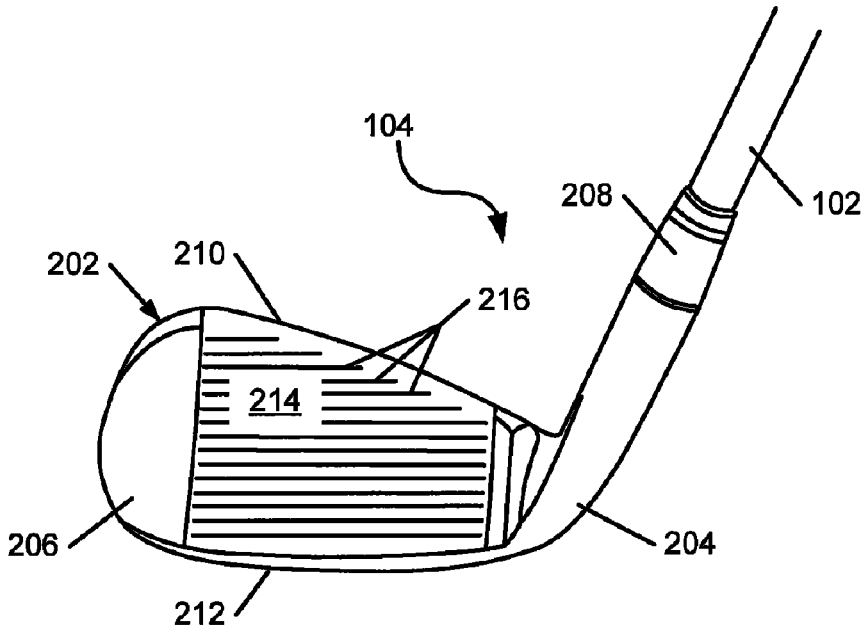
FIGS. 2A through 2C illustrates various views of an example golf club head in accordance with the present invention.

FIG. 2A illustrates one example golf club head 104 in accordance with this invention in more detail. As illustrated, this example golf club head 104 includes a body member 202 having a heel portion 204 and a toe portion 206. The heel portion 204 is attached to and/or extends from a hosel 208 (e.g., as a unitary or integral one piece construction, as separate connected elements, etc.) for connecting the shaft 102 to the club head body member 202. The body member 202 also includes a top portion 210 and a sole portion 212. A ball striking face 214 is provided between the top portion 210 and the sole portion 212, and between the toe 206 and the heel 204. The striking face 214 provides a contact area for engaging and propelling a golf ball in an intended direction. The striking face 214 may include grooves 216 (e.g., generally horizontal grooves 216 extending across the face 214 in the illustrated example) for the removal of water and/or grass from between the striking face 214 and a golf ball during a ball strike. Any number of grooves, desired groove patterns, and/or groove constructions may be provided (or even no grooves, if desired), including conventional groove patterns and/or constructions, without departing from this invention. The striking face 214 may be integrally formed as a unitary, one-piece construction with the remainder of the club head body member 202, or it may be a separate part attached to the club head body member 202 (e.g., via adhesives or cements; via welding, brazing, soldering, or other fusing techniques; via mechanical connectors; via friction fit; via retaining element structures; etc.).

The body member 202 and/or striking face 214 of the golf club head 104 may be constructed from a wide variety of different materials, including materials conventionally known and used in the art, such as steel, titanium, aluminum, magnesium, tungsten, alloys of these metals, graphite, polymers, fiber-reinforced materials, or composites, or combinations thereof. Also, if desired, the club head 104 may be made from any number of pieces (e.g., having a separate face plate, etc.) and/or by any construction technique, including, for example, casting, forging, welding, and/or other methods known and used in the art.

Figure 2C:
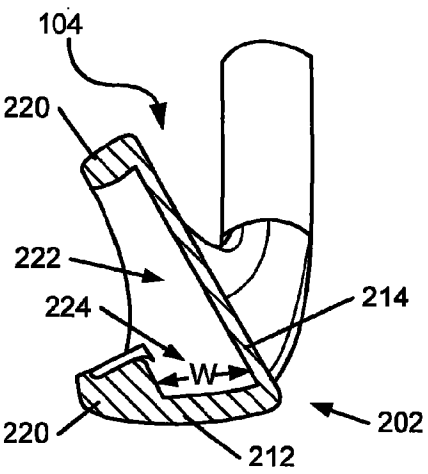
Figure 2B:
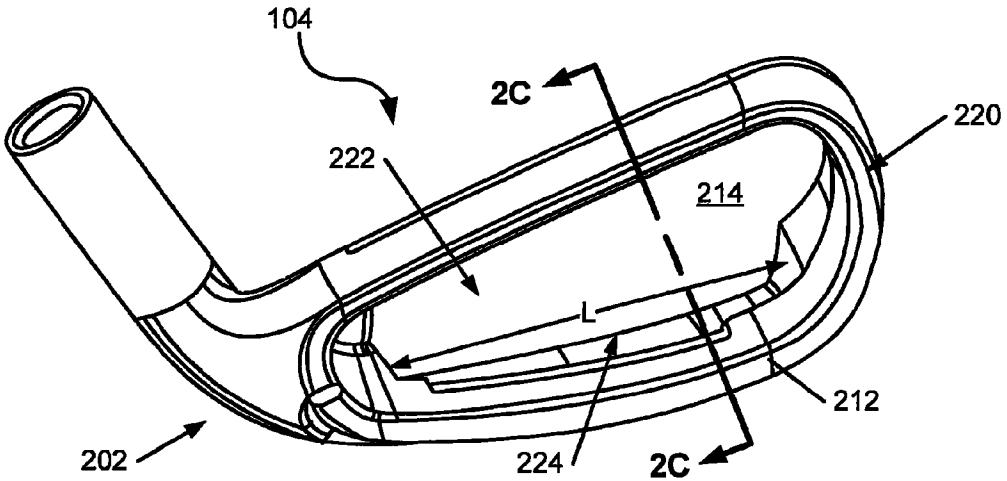

FIG. 2B illustrates a rear or back side view of an iron type golf club head 104 in accordance with at least some examples of this invention, and FIG. 2C illustrates a general cross sectional view of such a club head (e.g., taken along line 2C-2C in FIG. 2B). As illustrated, in this example structure, the rear of the club head 104 forms a perimeter weighted (note perimeter weight member 220) cavity back (note rear cavity 222) construction. The sole portion 212 of the club head 104 extends around and from the club head face 214 and forms the very bottom of the club head structure 104, and from there it extends upward to form a lowermost portion of the perimeter weight member 220 and a portion of the rear or back side of the club head structure 104.

The sole portion 212 of the club head 104 (including the upward extending portion thereof that forms the bottom of the perimeter weight member 220) in this illustrated example has a generally downwardly extending cavity 224 defined therein. This downwardly extending cavity 224 includes an open and exposed top surface. The forwardmost wall of the cavity 224 is defined by the rear surface of the ball striking face 214 (although, if desired, another element may be disposed between the ball striking face 214 and the rear cavity 222 without departing from this invention), and the side and rear walls of the cavity 224 are defined by the sole portion 212 of body member 202.

Notably, as illustrated in FIGS. 2B and 2C, the overall longitudinal length L of the cavity 224 (in the heel-to-toe direction, e.g., the maximum dimension from the toe edge of the cavity 224 to the heel edge) may be much greater than its overall width dimension W (in the face-to-rear direction, e.g., the maximum dimension from the rear of the ball striking face 214 to the back side surface of the cavity 224 in the sole portion 212). The ratio of the maximum overall length dimension L to the maximum overall width W (L/W) may be at least 2/1 or even at least 3/1.

Figure 3B:
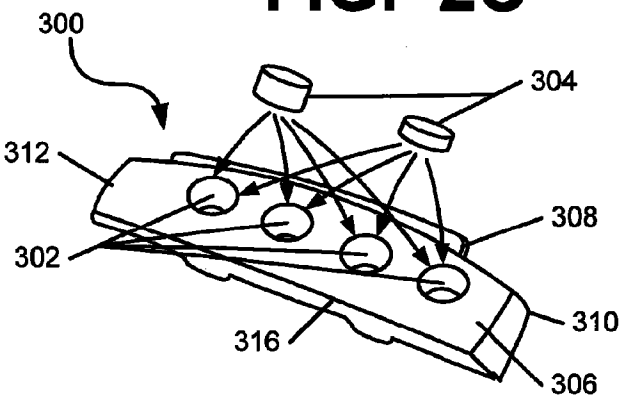
FIGS. 3A and 3B illustrate various views of an example insert member structure in accordance with the present invention.
Figure 3A:
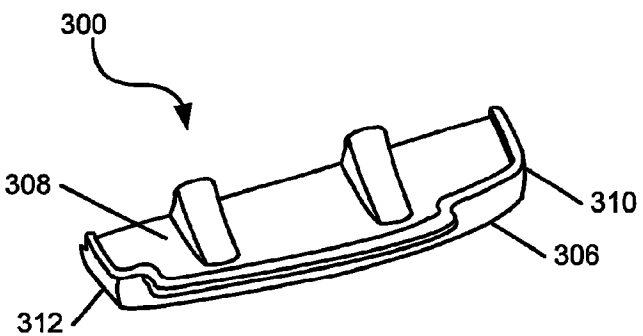

In golf club head structures (e.g., club head 104) in accordance with examples of this invention, the lower sole member cavity 224 will be filled (at least substantially filled) with an insert structure 300. The insert structure may fill at least 75%, at least 80%, at least 90%, or even at least 95% of the overall cavity 224 volume. FIGS. 3A and 3B illustrate an example insert structure 300 in accordance with some examples of this invention. The insert structure 300 potentially may perform a variety of functions. For example, the insert structure 300 may dampened vibrations produced when the golf club head 104 contacts another object, such as a golf ball, and thereby alter the sound and/or reduce the vibrational response transmitted to the user's hands. As another example, the insert structure 300 may include one or more weight ports 302 that enable mounting of one or more weight members 304 in the insert 300. This feature can be used, for example, to selectively alter, position, customize, and "fine-tune" weight in the club head structure 104, e.g., to produce a consistent club "swing weight" throughout a set, to produce a draw biased club, to produce a fade biased club, to help compensate for swing faults that tend to produce a hooking ball flight, to help compensate for swing faults that tend to produce a slicing ball flight, etc. Various potential structural features and characteristics of the insert structure 300 will be described in more detail below.

If desired, at least some (e.g., a major portion) of the insert member 300 will be made from a material that is softer than the material from which the ball striking face 214 is made. In some example structures 300, the insert member will have a multi-piece construction, with a lower portion 306 made from a relatively soft and flexible material (e.g., a polymer having a Shore A hardness of 85 or less, and in some examples, 80 or less, 75 or less, 70 or less, 65 or less, or even 60 or less, such as a rubber, vinyl, polyurethane, or other relatively soft and flexible materials). This feature generally will allow the lower portion 306 of the insert member 300 to dampen vibrations caused when a golf ball or other object is struck. This lower portion 306 may make up the majority of the insert structure 300.

When made from a multi-piece construction, an upper portion 308 of the insert member 300 may be made from a harder material than the material making up the lower portion 306 of the insert member 300. As a more specific example, the upper portion 308 of the insert member 300 may be made from a polymer having a Shore A hardness of at least 75, and in some examples, at least 80, at least 85, at least 90, or even at least 95, such as a thermoplastic material (e.g., a TPU), a thermosetting material, a PEBAX material, or the like. This feature provides a strong, hard, and stable exposed surface for the insert member 300 and helps prevent undesired deformation, damage, and the like to the underlying and softer lower portion 306. When made from multiple materials having different hardness, this multi-piece construction (e.g., having a softer lower portion 306 and a harder upper portion 308) may be called a "dual durometer" construction or "multi-durometer" construction in this specification.

While any desired proportions of a dual or multi-durometer insert member 300 structure may be made from the softer portion 306 and the harder portion 308, in this illustrated example structure 300, the softer portion 306 makes up the vast majority of the overall structure 300 such that the harder portion 308 constitutes substantially a thin cover layer over the softer portion 306. If desired, at least some portions of this thin cover layer 308 may be less than 5 mm thick, and in some examples, less than 2 mm thick, or even less than 1 mm thick. The softer portion 306 may make up at least 75% of the overall insert member 300 volume, and even at least 80% or 85% of the overall volume. In one more specific example, the softer portion 306 will have a hardness of about 50-55 Shore A and the harder portion 308 will have a hardness of about 80-85 Shore A.

As another example, if desired, the insert member 300 may be made from a single piece construction and/or from a material having a single hardness level (e.g., of approximately 70 to 80 Shore A hardness, including about 75 Shore A). As yet another example, if desired, a portion of a single piece (or single material) insert member 300 may be treated to alter its hardness, e.g., to make one portion harder or softer than another portion, such as by using chemical or radiation treatments (e.g., laser treatments) on one or more surfaces of the insert member 300, by coating or impregnating one or more surfaces of the insert member 300, by applying a substrate base layer to one or more surfaces of the insert member 300, etc.

FIG. 3B illustrates that the underside of the insert member 300 (e.g., in softer portion 306) includes one or more weight ports 302 into which one or more weight members 304 may be mounted. Any number of weight ports 302 may be provided in the insert member structure 300, at any desired positions along the insert member 300, without departing from this invention. Moreover, any number of weight members 304 may be mounted in any desired number of positions among the various weight ports 302 without departing from the invention. For example, any individual weight port 302 may have one or more weight members 304 mounted therein, or an individual weight port 302 may be left empty. The weight members 304 may be permanently mounted in the weight ports 302 (e.g., using cements or adhesives, using fusing techniques, etc.) or they may be removably mounted in the weight ports 302 (e.g., using a friction fit, using threads or other mechanical connectors, etc.).

The weight members 304 may be of any desired mass or construction, and they may be selectively placed at any desired position(s) among the ports 302 to produce a desired effect. For example, in some golf club head structures in accordance with this invention, the weight members 304 may be relatively lightweight (e.g., a gram or two) and selectively positionable among the weight ports 302 so as to produce a club having a desired "swing weight". Every iron club in a set may be selectively weighted so as to have the same "swing weight," which helps provide a more consistent swing feel for users throughout the set.

If desired, however, weight members 304 also may be selectively located (with selected masses) so as to affect ball flight. For example, providing additional weight in the club head toe end (by using the weight port(s) 304 located toward the toe end 310 of the insert member 300), a club head can be biased to produce more of a "fading" ball flight and/or a club head can be designed to help compensate for swing flaws that tend to produce a "hooking" ball flight. On the other hand, by providing additional weight in the club head heel end (by using the weight port(s) 304 located toward the heel end 312 of the insert member 300), a club head can be biased to produce more of a "drawing" ball flight and/or a club head can be designed to help compensate for swing flaws that tend to produce a "slicing" ball flight. Insert members including weight members and weight ports of the types described above can be used both swing weighting and ball flight biasing purposes, if desired.

In at least some example structures in accordance with this invention, the insert 300 will include a major side surface 316 intended to lie adjacent (and optionally in contact with) the rear surface of the ball striking face 214 (or other member). All or substantially all (e.g., at least 75%, or even at least 80%, 85%, or 90%) of this side surface 316 may be exposed material that is softer than the ball striking face 214 (e.g., material 306), to help in the vibration/noise damping characteristics.

Figure 4A:
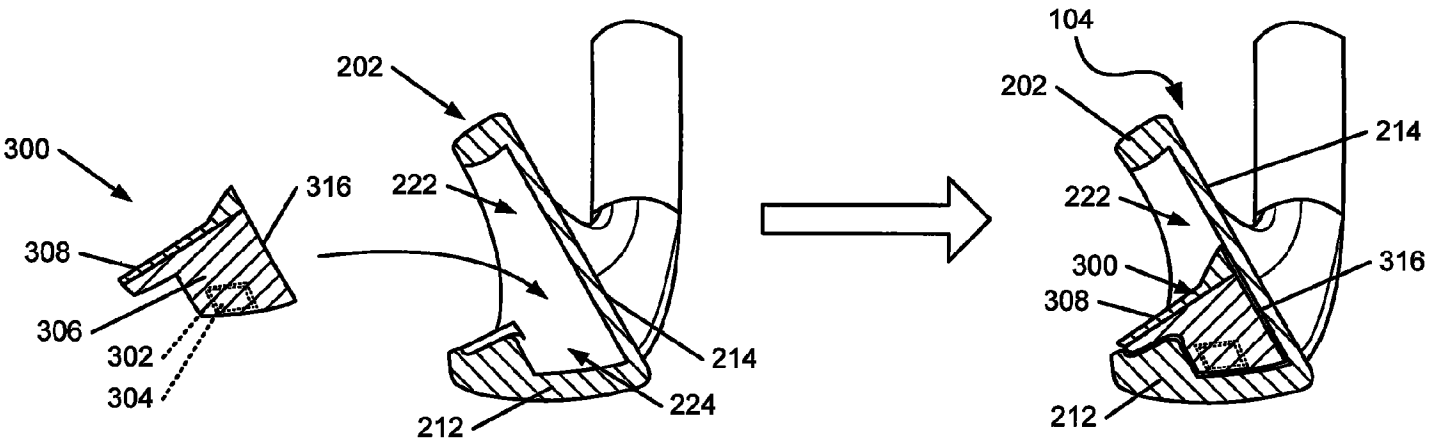
FIGS. 4A and 4B illustrate assembly and the final structure of an example golf club head structure in accordance with this invention.

FIG. 4A illustrates an example of assembly of a golf club head 104 including an insert member 300 in accordance with one example of this invention. As illustrated, the insert member 300 is equipped to include one or more weight members 304 in one or more of the weight ports 302 provided in the bottom surface of the insert member structure 300 (optionally, in a releasable or removable manner, as described above). The insert member 300 then is inserted into the open top surface providing access to the cavity 224 defined in the club head body member 202 by the sole portion 212 and the rear surface of the ball striking face 214.

As shown in the right hand side of FIG. 4A, the insert member 300 may fit within the cavity 224 such that a relatively large major surface 316 of the insert member 300 lies immediately adjacent (and optionally in direct contact with) the back side of the ball striking face 214. As noted above, this feature provides a relatively large contact surface to help dampen vibrations as the relatively soft and flexible material of portion 306 is available to dampen vibrations caused when a ball strikes the ball striking face 214. Optionally, if desired, a layer of adhesive (for securing the insert member 300 in the cavity 224) may lie between the major surface 316 and the rear surface of the ball striking face 214. Alternatively, the insert member 300 may be secured in the cavity 224 in another manner, optionally in a removable or releasable manner, such as through the use of screws, retaining members, friction fits, or other mechanical or releasable connectors.

Figure 4B:
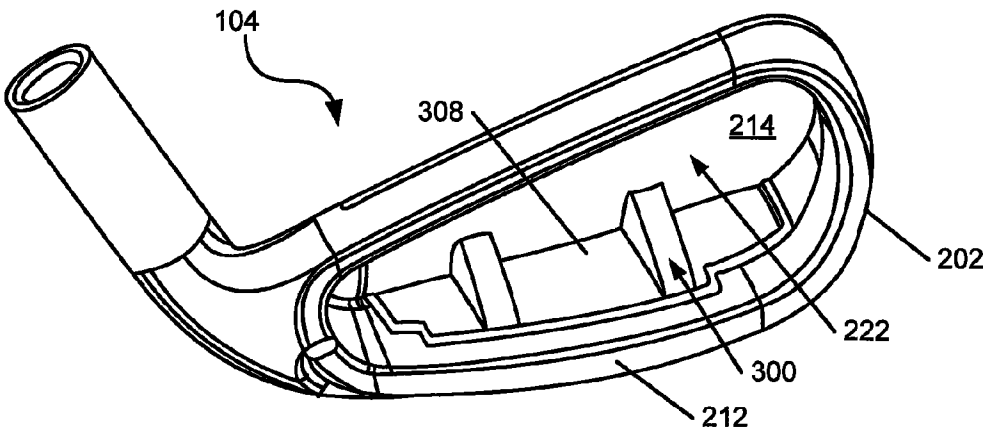

FIG. 4B illustrates an example of the finished rear of a club head structure 104 including the club head body 202 and the insert member 300 provided therein. As shown, in this illustrated example structure 104, only the relatively hard top surface 308 of the insert member 300 remains exposed through the opening in the sole portion 212 providing access to the cavity 224 (and the softer lower portion 306 is protected by the walls of the cavity 224 (e.g., in the sole portion 212 and the back surface of the ball striking face 214) and the top surface 308 of the insert member 300). Notably, however, the complete cavity back 222 of the perimeter weighted iron structure is not filled with the insert member 300 (rather, a relatively large portion of the rear surface of the ball striking face 214 remains exposed through the cavity 222). This feature helps reduce the overall weight of the insert member 300 and the club head body member 202, and it helps maintain the center of gravity of the overall club head structure 104 lower in the structure. The size of the insert member 300 (so as not to completely cover cavity 222) also allows for easier insertion of the insert member 300 down into the cavity 224 defined in the sole portion 212. In some structures in accordance with this invention, at least 30%, at least 40%, at least 50%, or even at least 75% of the exposed rear surface of the ball striking face 214 (or other surface defining the rear cavity of a cavity back iron) in the body member 202 will remain exposed after the insert member 300 is inserted into the cavity 224 defined in the club head sole portion 212.

Many further variations in the club head and/or insert member structure may be provided without departing from the invention. For example, if desired, the insert member 300 may constitute multiple independent parts that are separately introduced into and secured in the cavity 224. As another example, if desired, the weight ports and/or openings thereto may be provided in other parts of the insert member 300 and/or the club head body member structure 202 without departing from this invention. For example, if desired, weights could be inserted into the insert member 300 through one or more openings provided through the top surface 308 thereof. As another example, if desired, weight members could be inserted into the insert member 300 through the side surface 316 or the surface opposite thereto. Other structural arrangements are possible without departing from this invention.

As mentioned above, golf club heads in accordance with examples of the present invention may be incorporated into a set, e.g., a set of iron and/or hybrid type golf clubs. For example, aspects of the present invention may be used to provide a club set with increasing numbered iron golf clubs, such as two or more of hybrid type clubs, driving irons, a zero iron, a one iron, a two iron, a three iron, a four iron, a five iron, a six iron, a seven iron, an eight iron, a nine iron, a ten iron, a pitching wedge, a lob wedge, a gap wedge, a sand wedge, etc. With the present invention, a golfer, a club designer, and/or a club fitter may modify swing weight and/or the position of the center of gravity for each golf club to meet the player's unique requirements, skill, or playing style (e.g., to provide a consistent swing "feel" throughout the set, to bias for certain desired ball flight characteristics, etc.). For each club in the set, the insert member (and/or other features of the club head, such as perimeter weighting members, weighting members, etc) may progressively change to alter the center of gravity of one club member with respect to the others in the set, to make the center of gravity better suited for use of the particular club, optionally customized for use by a specific golfer. Various "feel" characteristics of the club also may be controlled, as described above.

Also, while the invention has been described primarily in terms of use in an iron type golf club head (including iron type hybrid golf club heads), those skilled in the art will appreciate that aspects and features of this invention are not limited to use with iron type golf club heads. For example, if desired, putter type and/or wood type body members may be substituted for the iron type club head body members illustrated in FIGS. 1 through 4B, and the same or similar features and/or structures could be included in a putter or wood structure without departing from this invention.

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1 through 4B may be used individually and/or in any combination or subcombination without departing from this invention.

We claim:

1. An iron golf club head, comprising: a ball striking face including a front ball striking surface and a single rear surface directly opposite and substantially parallel to the ball striking surface, wherein the rear surface comprises an area contiguous with a perimeter of the golf club head;

a sole portion extending rearward from the ball striking face and forming a bottom of the club head, and extending upward from the bottom of the club head to form a lowermost portion of a perimeter weight member and a portion of the rear of the club head, the sole portion and at least a portion of the rear surface defining a cavity that has an open upper portion;

an insert element mounted in the cavity, wherein the insert element includes a side surface, wherein at least a portion of the side surface lies immediately adjacent to and contacts the rear surface, an upper surface exposed at the open upper portion of the cavity and an opposite lower surface, wherein the lower surface includes at least a first weight port therein; and a first weight member mounted in the first weight port, wherein the insert element includes a first polymer member in which the first weight port is formed and a second polymer member from which the upper surface formed, wherein the first polymer member is softer than the second polymer member, wherein the second polymer member includes a continuous cover layer which completely covers an upper surface of the first polymer member and prevents exposure of the first polymer member, wherein the side surface has at least a first portion formed by a first side surface of the first polymer member and a second portion formed by a second side surface of the second polymer member, such that the first and second side surfaces combine contiguously to form the side surface of the insert element, and wherein at least a portion of the first side surface and at least a portion of the second side surface lies immediately adjacent to or contacts the rear surface wherein the first polymer member of the insert member is L-shaped and defines a tail portion which is positioned in an upper half of the insert element and below the second polymer member of the insert member, wherein the tail portion extends rearwardly away from the side surface of the insert member that lies immediately adjacent to and contacts the rear surface of the ball striking face, wherein a recess is defined in a top of the lowermost portion of the perimeter weight member, rearward of the cavity, wherein the tail portion is configured to extend over the perimeter weight member and fill the recess defined in the top of the lowermost portion of the perimeter weight member.

2. An iron golf club head according to claim 1, wherein the lower surface includes a second weight port, and wherein one of the first weight port or the second weight port is located at a toe end of the insert element and the other weight port is located at a heel end of the insert element.

3. An iron golf club head according to claim 1, wherein the lower surface includes a second weight port, and wherein the golf club head further includes a second weight member mounted in the second weight port.

4. An iron golf club head according to claim 1, wherein the insert element substantially fills the cavity, and wherein at least a portion of a side surface of the first polymer member lies immediately adjacent to or contacts the rear surface.

5. An iron golf club head according to claim 1, wherein the first polymer member has a hardness of 70 Shore A or less and the second polymer member has a hardness of 85 Shore A or greater.

6. An iron golf club head according to claim 1, wherein the cavity has an overall length dimension in a heel-to-toe direction of the club head that is at least twice its overall width dimension in a face-to-rear direction.

7. An iron golf club head according to claim 1, wherein the first weight port is located at a toe end of the insert element.

8. An iron golf club head according to claim 1, wherein the first weight port is located at a heel end of the insert element.

9. An iron golf club head according to claim 1, wherein the second polymer member includes at least one wedge portion at an upper surface of the second polymer member, wherein a height of the wedge portion increases as the wedge portion extends towards the rear surface directly opposite to the ball striking surface.

10. An iron golf club, comprising:

a golf club head including: (a) a ball striking face including a front ball striking surface and a single rear surface directly opposite and substantially parallel to the ball striking surface, wherein the rear surface comprises an area contiguous with a perimeter of the golf club head; (b) a sole portion extending rearward from the ball striking face and forming a bottom of the club head, and extending upward from the bottom of the club head to form a lowermost portion of a perimeter weight member and a portion of the rear of the club head, the sole portion and at least a portion of the rear surface defining a cavity that has an open upper portion, (c) an insert element mounted in the cavity, wherein the insert element includes a side surface, wherein at least a portion of the side surface lies immediately adjacent to and contacts the rear surface, an upper surface exposed at the open upper portion of the cavity and an opposite lower surface, wherein the lower surface includes at least a first weight port, and (d) a first weight member mounted in the first weight port; and a shaft member engaged with the golf club head, wherein the insert element includes a first polymer member in which the first weight port is formed and a second polymer member from which the upper surface formed, wherein the first polymer member is softer than the second polymer member, wherein the second polymer member includes a continuous cover layer which completely covers an upper surface of the first polymer member and prevents exposure of the first polymer•member, wherein the side surface has at least a first portion formed by a first side surface of the first polymer member and a second portion formed by a second side surface of the second polymer member, such that the first and second side surfaces combine contiguously to form the side surface of the insert element, and wherein at least a portion of the first side surface and at least a portion of the second side surface lies immediately adjacent to or contacts the rear surface, wherein the first polymer member of the insert member is L-shaped and defines a tail portion which is positioned in an upper half of the insert element and below the second polymer member of the insert member, wherein the tail portion extends rearwardly away from the side surface of the insert member that lies immediately adjacent to and contacts the rear surface of the ball striking face, wherein a recess is defined in a top of the lowermost portion of the perimeter weight member, rearward of the cavity, wherein the tail portion is configured to extend over the perimeter weight member and fill the recess defined in the top of the lowermost portion of the perimeter weight member.

11. An iron golf club according to claim 10, wherein the lower surface includes a second weight port, and wherein one of the first weight port or the second weight port is located at a toe end of the insert element and the other weight port is located at a heel end of the insert element.

12. An iron golf club according to claim 10, wherein the lower surface includes a second weight port, and wherein the golf club head further includes a second weight member mounted in the second weight port.

13. An iron golf club according to claim 10, wherein the first polymer member has a hardness of 70 Shore A or less and the second polymer member has a hardness of 85 Shore A or greater.

14. An iron golf club according to claim 10, wherein the cavity has an overall length dimension in a heel-to-toe direction of the club head that is at least twice its overall width dimension in a face-to-rear direction.

15. An iron golf club according to claim 10, wherein the first weight port is located at a toe end of the insert element.

16. An iron golf club according to claim 10, wherein the first weight port is located at a heel end of the insert element.

17. An iron golf club according to claim 10, further comprising:

a grip member engaged with the shaft member.

18. An iron golf club according to claim 10, wherein the second polymer member includes at least one wedge portion at an upper surface of the second polymer member, wherein a height of the wedge portion increases as the wedge portion extends towards the rear surface directly opposite to the ball striking surface.

19. A method for producing an iron golf club head, comprising:

providing a club head body including a ball striking face including a front ball striking surface and a single rear surface directly opposite and substantially parallel to the ball striking surface, wherein the rear surface comprises an area contiguous with a perimeter of the golf club head, and a sole portion extending rearward from the ball striking face and forming a bottom of the club head, and extending upward from the bottom of the club head to form a lowermost portion of a perimeter weight member and a portion of the rear of the club head, wherein the sole portion and at least a portion of the rear surface define a cavity that has an open upper portion;

providing an insert element that includes a side surface, wherein at least a portion of the side surface lies immediately adjacent to and contacts the rear surface, an upper surface and an opposite lower surface, wherein the lower surface includes at least a first weight port therein; inserting a first weight member in the first weight port; and inserting the insert element into the cavity such that the upper surface of the insert element is exposed at the open upper portion of the cavity, wherein the insert element includes a first polymer member in which the first weight port is formed and a second polymer member from which the upper surface formed, wherein the first polymer member is softer than the second polymer member, wherein the second polymer member includes a continuous cover layer which completely covers an upper surface of the first polymer member and prevents exposure of the first polymer member, wherein the side surface has at least a first portion formed by a first side surface of the first polymer member and a second portion formed by a second side surface of the second polymer member, such that the first and second side surfaces combine contiguously to form the side surface of the insert element, and wherein at least a portion of the first side surface and at least a portion of the second side surface lies immediately adjacent to and contacts the rear surface, wherein the first polymer member of the insert member is L-shaped and defines a tail portion which is positioned in an upper half of the insert element and below the second polymer member of the insert member, wherein the tail portion extends rearwardly away from the side surface of the insert member that lies immediately adjacent to and contacts the rear surface of the ball striking face, wherein a recess is defined in a top of the lowermost portion of the perimeter weight member, rearward of the cavity, wherein the tail portion is configured to extend over the perimeter weight member and fill the recess defined in the top of the lowermost portion of the perimeter weight member.

20. A method according to claim 19, further comprising:

removing the insert element from the cavity;

removing the first weight member from the first weight port;

inserting a second weight member into the first weight port; and inserting the insert element with the second weight member into the cavity.

21. A method according to claim 19, further comprising:

removing the insert element from the cavity;

removing the first weight member from the first weight port; inserting the first weight member into a second weight port defined in the lower surface of the insert element; and inserting the insert element with the first weight member in the second weight port into the cavity.

22. A method according to claim 19, further comprising:

removing the insert element from the cavity;

removing the first weight member from the first weight port;

inserting a second weight member into a second weight port defined in the lower surface of the insert element; and inserting the insert element with the second weight member in the second weight port into the cavity.

23. A method according to claim 19, further comprising:

inserting a second weight member into a second weight port defined in the lower surface of the insert element; and inserting the insert element with the second weight member in the second weight port into the cavity.

24. A method according to claim 19, wherein the second polymer member includes at least one wedge portion at an upper surface of the second polymer member, wherein a height of the wedge portion increases as the wedge portion extends towards the rear surface directly opposite to the ball striking surface.

25. A method for producing an iron golf club, comprising:

providing a golf club head including: (a) a ball striking face including a front ball striking surface and a single rear surface directly opposite and substantially parallel to the ball striking surface, (b) a sole portion extending rearward from the ball striking face and forming a bottom of the club head, and extending upward from the bottom of the club head to form a lowermost portion of a perimeter weight member and a portion of the rear of the club head, wherein the sole portion and at least a portion of the rear surface define a cavity that has an open upper portion, (c) an insert element provided in the cavity, wherein the insert element includes a side surface, wherein at least a portion of the side surface lies immediately adjacent to and contacts the rear surface, an upper surface and an opposite lower surface, wherein the lower surface includes at least a first weight port therein, and wherein the upper surface of the insert element is exposed at the open upper portion of the cavity, and (d) a first weight member included in the first weight port; and engaging a shaft member with the golf club head, wherein the insert element includes a first polymer member in which the first weight port is formed and a second polymer member from which the upper surface formed, wherein the first polymer member is softer than the second polymer member, wherein the second polymer member includes a continuous cover layer which completely covers an upper surface of the first polymer member and prevents exposure of the first polymer member, wherein the side surface has at least a first portion formed by a first side surface of the first polymer member and a second portion formed by a second side surface of the second polymer member, such that the first and second side surfaces combine contiguously to form the side surface of the insert element, and wherein at least a portion of the first side surface and at least a portion of the second side surface lies immediately adjacent to and contacts the rear surface wherein the first polymer member of the insert member is L-shaped and defines a tail portion which is positioned in an upper half of the insert element and below the second polymer member of the insert member, wherein the tail portion extends rearwardly away from the side surface of the insert member that lies immediately adjacent to and contacts the rear surface of the ball striking face, wherein a recess is defined in a top of the lowermost portion of the perimeter weight member, rearward of the cavity, wherein the tail portion is configured to extend over the perimeter weight member and fill the recess defined in the top of the lowermost portion of the perimeter weight member.

26. A method according to claim 25, wherein the second polymer member includes at least one wedge portion at an upper surface of the second polymer member, wherein a height of the wedge portion increases as the wedge portion extends towards the rear surface directly opposite to the ball striking surface.

* * * * *